US010784560B1

(12) United States Patent
Baiz et al.

(10) Patent No.: US 10,784,560 B1
(45) Date of Patent: Sep. 22, 2020

(54) VEHICLE ANTENNA WITH ANTI-THEFT FEATURE

(71) Applicants: Enrique J. Baiz, Davie, FL (US); Osvaldo Izquierdo, Homestead, FL (US)

(72) Inventors: Enrique J. Baiz, Davie, FL (US); Osvaldo Izquierdo, Homestead, FL (US)

( * ) Notice: Subject to any disclaimer, the term of this patent is extended or adjusted under 35 U.S.C. 154(b) by 119 days.

(21) Appl. No.: 16/239,521

(22) Filed: Jan. 3, 2019

(51) Int. Cl.
*H01Q 1/20* (2006.01)
*H01Q 1/32* (2006.01)
*H01Q 1/12* (2006.01)

(52) U.S. Cl.
CPC ..... *H01Q 1/1214* (2013.01); *H01Q 1/3233* (2013.01); *H01Q 1/3283* (2013.01)

(58) Field of Classification Search
CPC ..... H01Q 1/20; H01Q 1/32
See application file for complete search history.

(56) References Cited

U.S. PATENT DOCUMENTS 2,481,823 A * 9/1949 Cejka ..... H01Q 21/10 343/882
2,563,540 A * 8/1951 Ludwig et al. ..... H01Q 1/084 174/151
2,771,604 A * 11/1956 Goldstein ..... H01Q 9/30 343/749
2,800,004 A * 7/1957 Schroter ..... A01B 61/025 464/39
2,836,648 A * 5/1958 Cejka ..... H01Q 1/1214 174/139
2,866,032 A * 12/1958 McCloud ..... H01H 9/102 337/175
3,873,985 A * 3/1975 Altmayer ..... H01Q 1/08 343/714
4,734,703 A * 3/1988 Nakase ..... H01Q 21/28 343/715
4,742,360 A * 5/1988 Carolus ..... H01Q 1/103 343/715
4,958,163 A * 9/1990 Leonard ..... H01Q 9/30 343/745
5,361,654 A * 11/1994 Rasipovits ..... B25B 9/00 81/120
5,583,522 A * 12/1996 Radomski ..... H01Q 1/1214 343/715

(Continued)

*Primary Examiner* — Graham P Smith
*Assistant Examiner* — Jae K Kim
(74) *Attorney, Agent, or Firm* — Quickpatents, LLC; Kevin Prince

(57) ABSTRACT

An after-market antenna for a vehicle includes an elongated body having a top end, a bottom end, and at least one peripheral side. The bottom end terminates with an axial bore extending partially through the body and adapted to receive an antenna wire within. The axial bore includes threads at the bottom end of the body that extend upward at least partially through the axial bore for receiving a conductive threaded shaft that projects out of the axial bore and that is adapted for screwing into a threaded antenna aperture of the vehicle. A first groove is formed around the body and has a back wall that is substantially circular in cross-section except for two opposing parallel sides adapted for contacting two opposing sides of a wrench that has a thickness that is smaller than a width of the first groove.

8 Claims, 5 Drawing Sheets

(56) References Cited

U.S. PATENT DOCUMENTS

| | | | | | |
|---|---|---|---|---|---|
| 5,697,797 | A * | 12/1997 | Wendel | H01Q 1/1214 | 411/342 |
| 5,995,066 | A * | 11/1999 | Muccioli | H01Q 1/3275 | 343/715 |
| 6,219,007 | B1 * | 4/2001 | Kline | H01Q 1/24 | 343/702 |
| 6,469,678 | B1 * | 10/2002 | Pullen | H01Q 1/1207 | 343/888 |
| 2002/0036594 | A1 * | 3/2002 | Gyenes | H01Q 9/14 | 343/745 |
| 2014/0015717 | A1 * | 1/2014 | Kowalewicz | H01Q 5/307 | 343/715 |
| 2014/0062814 | A1 * | 3/2014 | Gyenes | H01Q 9/30 | 343/745 |
| 2016/0207406 | A1 * | 7/2016 | Kauffmann | B60L 53/12 | |

* cited by examiner

VEHICLE ANTENNA WITH ANTI-THEFT FEATURE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to vehicle antennas, and more particularly to a vehicle antenna having anti-theft features.

DISCUSSION OF RELATED ART

Vehicle antennas are notorious for being broken away from the vehicle through vandalism, carelessness, automated car washes, or the like. Accordingly, many so-called after-market antennas are available in the marketplace, and include multiple different visual styles. All such after-market antennas include an antenna wire that is electrically connected to a threaded antenna aperture of the vehicle that is itself electrically connected to a radio, GPS unit, or other equipment needing an antenna.

Such after-market antennas are prone to theft since they can simply be unscrewed from the threaded antenna aperture of the vehicle, even by a casual thief who is unprepared with standard tools.

Therefore, there is a need for an after-market antenna that can be installed on a vehicle to replace a vehicle's missing or broken factory-installed antenna. Such a needed device would provide a means of theft deterrent that requires a special tool to remove the antenna from the vehicle once it's installed. Such a needed invention would be relatively simple to manufacture, transport, install and use. The present invention accomplishes these objectives.

SUMMARY OF THE INVENTION

The present device is an antenna for a vehicle of the type having a threaded antenna aperture traversing a body of the vehicle. The threaded antenna aperture is electrically connected with a radio or other equipment requiring an antenna to operate, and the antenna of the present invention is of the type referred to in the market as an "after-market antenna."

An elongated body has a top end, a bottom end, and at least one peripheral side. The bottom end terminates with an axial bore extending partially through the body and is adapted to receive an electrically-conductive antenna wire within. The axial bore includes threads at the bottom end of the body that extend upward at least partially through the axial bore. A conductive threaded shaft projects out of the axial bore and is adapted for threading (that is, screwing) into the threaded antenna aperture of the vehicle.

In some embodiments the elongated body is made from a non-conductive material such as plastic, epoxy resin, or the like. In other embodiments the elongated body is made from aluminum or other metal, and then anodized to render the body non-conductive between the antenna wire and the body of the vehicle. Alternately an electric insulator may be placed between the bottom end of the body and the vehicle body.

A first groove is formed around the at least one peripheral side of the body, preferably proximate the bottom end of the elongated body. The first groove has a back wall that is substantially circular in cross-section except for two opposing parallel sides adapted for contacting two opposing sides of a wrench that has a thickness that is smaller than a width of the first groove, which is preferably less than 1 mm in width so as to deter theft, since common prior art wrenches are considerably thicker than 1 mm, and since using a channel-lock or vice-grip type wrench on the elongated body will likely damage the body and reduce the value and ornamental appeal of the antenna. In some embodiments, at least one additional groove is formed around the at least on one peripheral side of the body proximate the first groove.

In use, with the antenna wire and the conductive threaded shaft screwed into the axial bore, and with the bottom end of the conductive threaded shaft screwed into the threaded antenna aperture of the vehicle, the body is rotated with the wrench at the first groove to secure the body to the vehicle with the antenna wire electrically connected with the threaded antenna aperture of the vehicle.

In an alternate embodiment of the antenna, resembling a cruise missile for example, the elongated body includes a threaded axial aperture into which a threaded cone piece is threaded or screwed, and which is preferably made from a material having a visual distinction with that of the elongated body.

The present invention is an after-market antenna that can be installed on a vehicle to replace a vehicle's missing or broken factory-installed antenna, and still provide the same or even improved reception. The present device provides a means of theft deterrent that requires a special tool, the thin wrench, to remove the antenna from the vehicle once it's installed. The present invention is relatively simple to manufacture, transport, install and use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
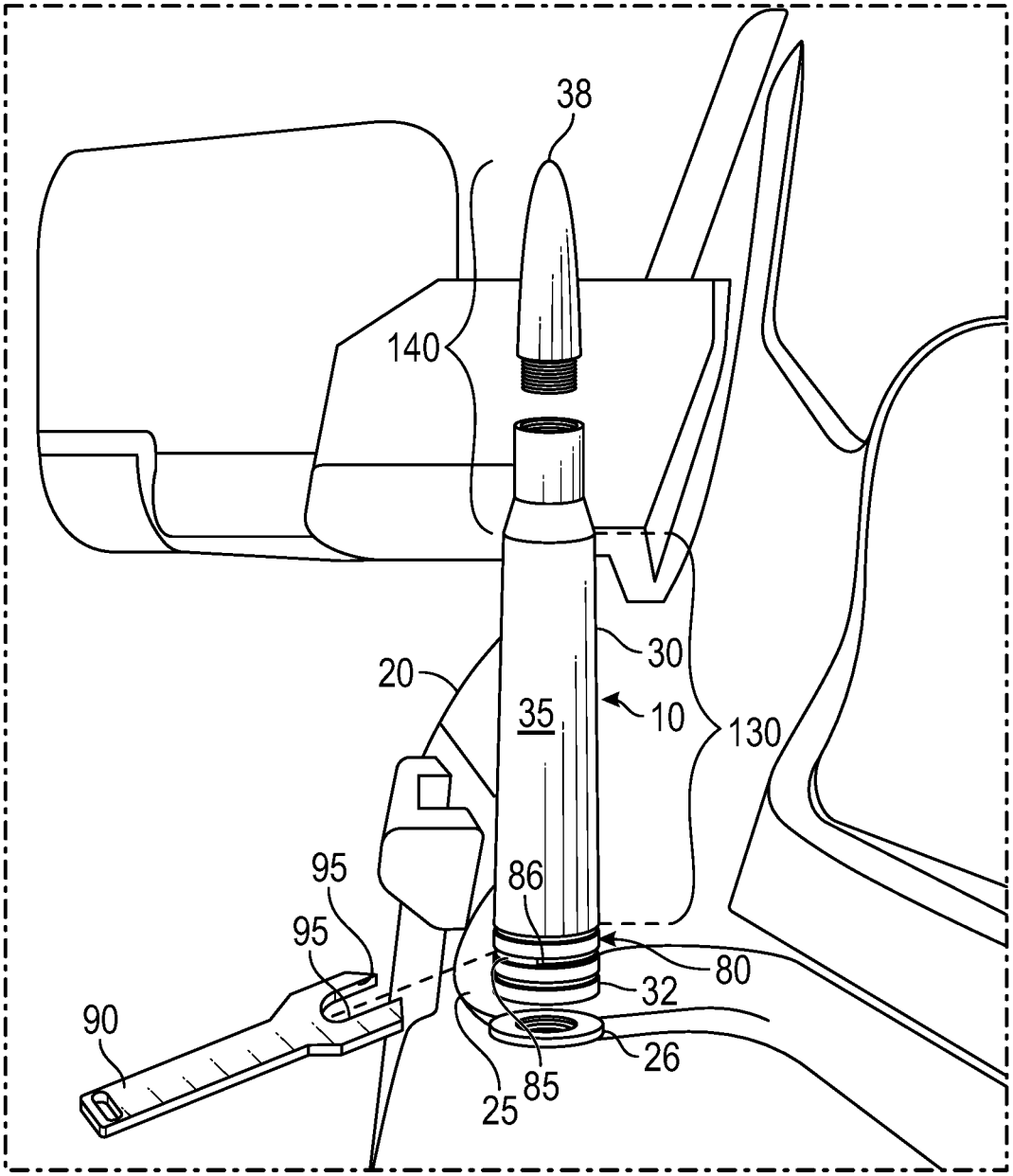
FIG. 1 is a perspective view showing an antenna of the invention exploded away from a vehicle having an antenna aperture, a wrench exploded away from a body of the antenna.
Figure 2:
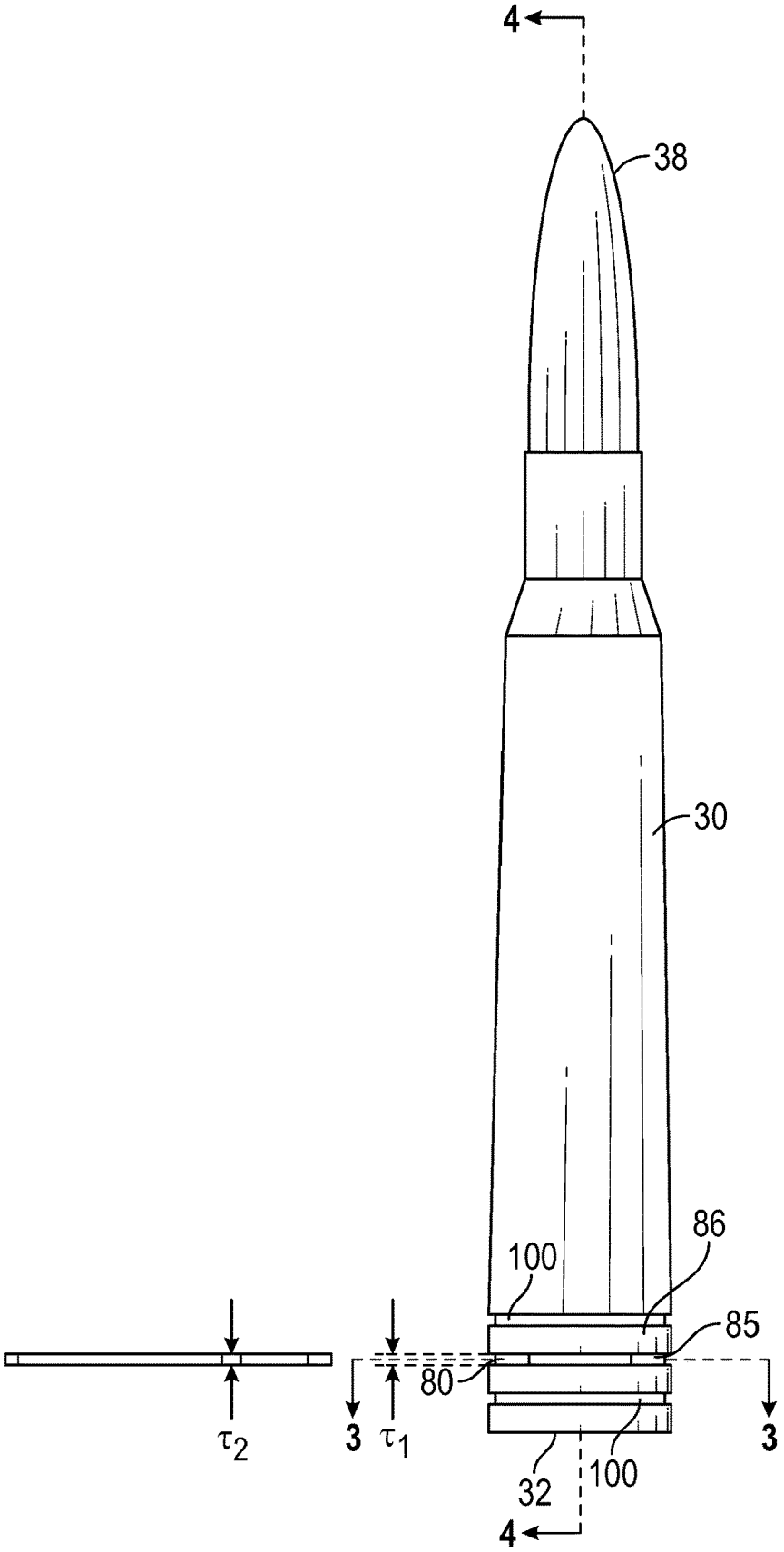
FIG. 2 is a front elevational view of the invention, illustrated with the wrench exploded away from the body of the antenna.

FIGS. 1 and 2 illustrate an antenna 10 for a vehicle 20 of the type having a threaded antenna aperture 26 traversing a body 25 of the vehicle 20. The threaded antenna aperture 26 is electrically connected with a radio (not shown) or other equipment requiring an antenna to operate.

Figure 4:
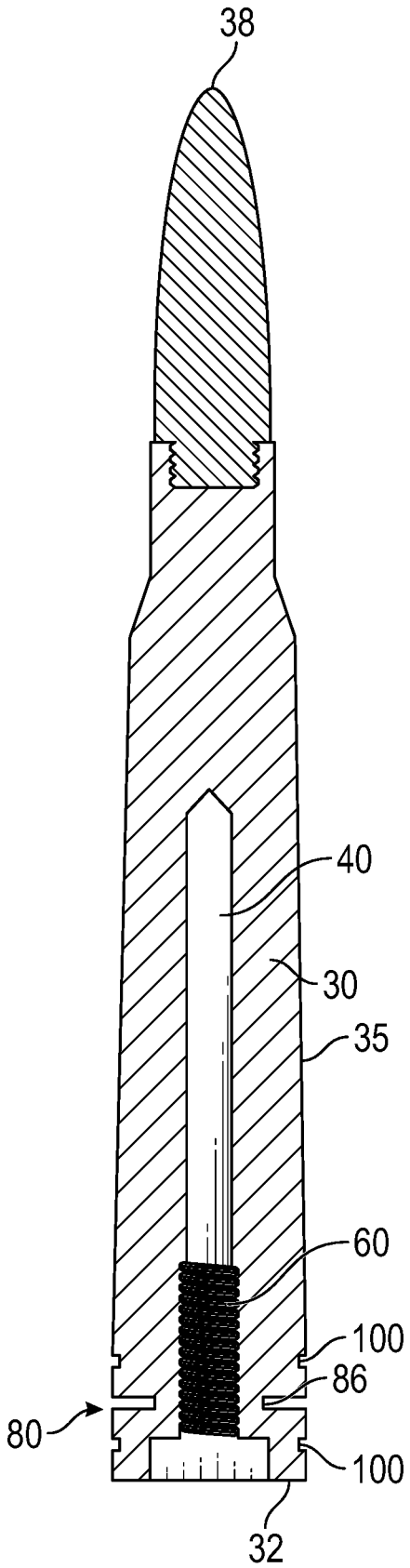
FIG. 4 is a cross-sectional view of the invention, taken along line 4-4 of FIG. 2, illustrating an axial bore of the body.
Figure 5:
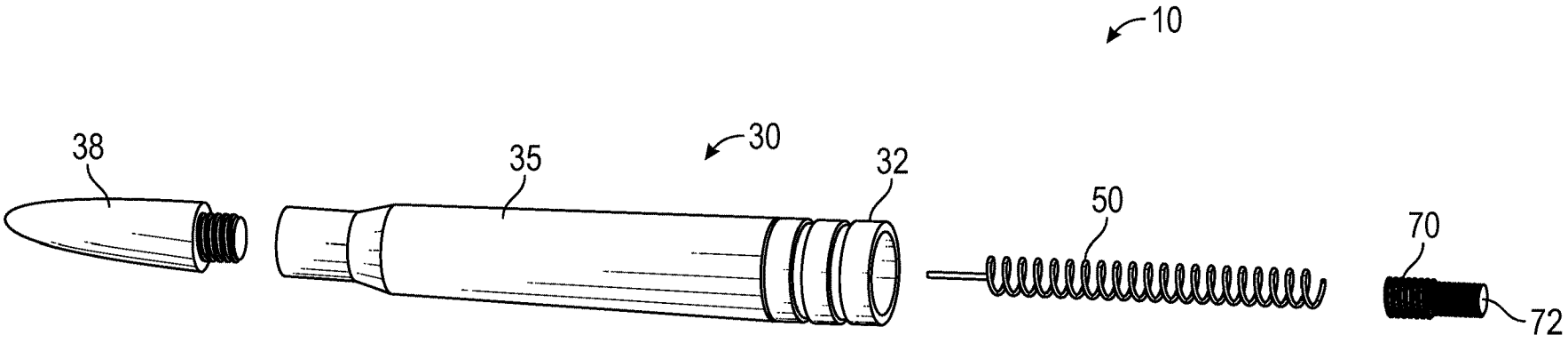
FIG. 5 is an exploded perspective view of an alternate embodiment of the invention, illustrated to show an antenna wire and a threaded shaft that engage the axial bore.

An elongated body 30 has a top end 38, a bottom end 32, and at least one peripheral side 35. The bottom end 32 terminates with an axial bore 40 (FIG. 4) extending partially through the body 30 and is adapted to receive an electrically-conductive antenna wire 50 (FIG. 5) within. The axial bore 40 includes threads 60 at the bottom end 32 of the body 30 that extend upward at least partially through the axial bore 40. A conductive threaded shaft 70 (FIG. 5) projects out of the axial bore 40 and is adapted for threading (or screwing) into the threaded antenna aperture 26 of the vehicle 20. In a first preferred embodiment, visually resembling a spike, the bottom end 32 of the elongated body 30 includes a generally cylindrical section 130, and the top end 38 of the elongated body 30 includes a generally conical section 140 (FIG. 1).

In some embodiments the elongated body 30 is made from a non-conductive material such as plastic, epoxy resin, or the like. In other embodiments the elongated body 30 is made from aluminum or other metal, and then anodized to render the body non-conductive between the antenna wire 50 and the body 25 of the vehicle 20. Alternately an electric insulator (not shown) may be placed between the bottom end 32 of the body 30 and the vehicle body 25.

Figure 3:
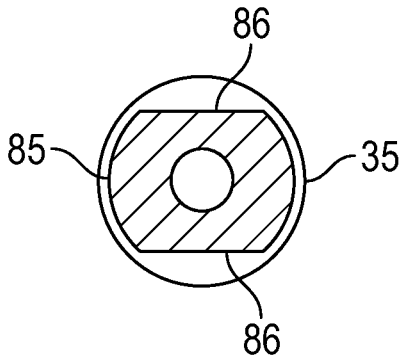
FIG. 3 is a cross-sectional view of the invention, taken alone line 3-3 of FIG. 2.

A first groove 80 is formed around the at least one peripheral side 35 of the body 30, preferably proximate the bottom end 32 of the elongated body 30. The first groove 80 has a back wall 85 that is substantially circular in cross-section (FIG. 3) except for two opposing parallel sides 86 adapted for contacting two opposing sides 95 of a wrench 90 (FIGS. 1 and 6) that has a thickness $T_2$ that is smaller than a width of the first groove $T_1$, which is preferably less than 1 mm to deter theft from a criminal, since most wrenches are substantially thicker than 1 mm. Clearly channel-lock type plyers could be applied to the body 30 to remove the body 30 from the vehicle 20, but such a tool would likely damage the body 30 and substantially reduce its value to the criminal. In some embodiments, at least one additional groove 100 (FIGS. 2 and 4) is formed around the at least one peripheral side 35 of the body 30 proximate the first groove 80.

In use, with the antenna wire 50 and the conductive threaded shaft 70 screwed into the axial bore 40, and with the bottom end 72 of the conductive threaded shaft 70 screwed into the threaded antenna aperture 26 of the vehicle 20, the body 30 is rotated with the wrench 90 at the first groove 80 to secure the body 30 to the vehicle 20 with the antenna wire 50 electrically connected with the threaded antenna aperture 26 of the vehicle 20.

Figure 6:
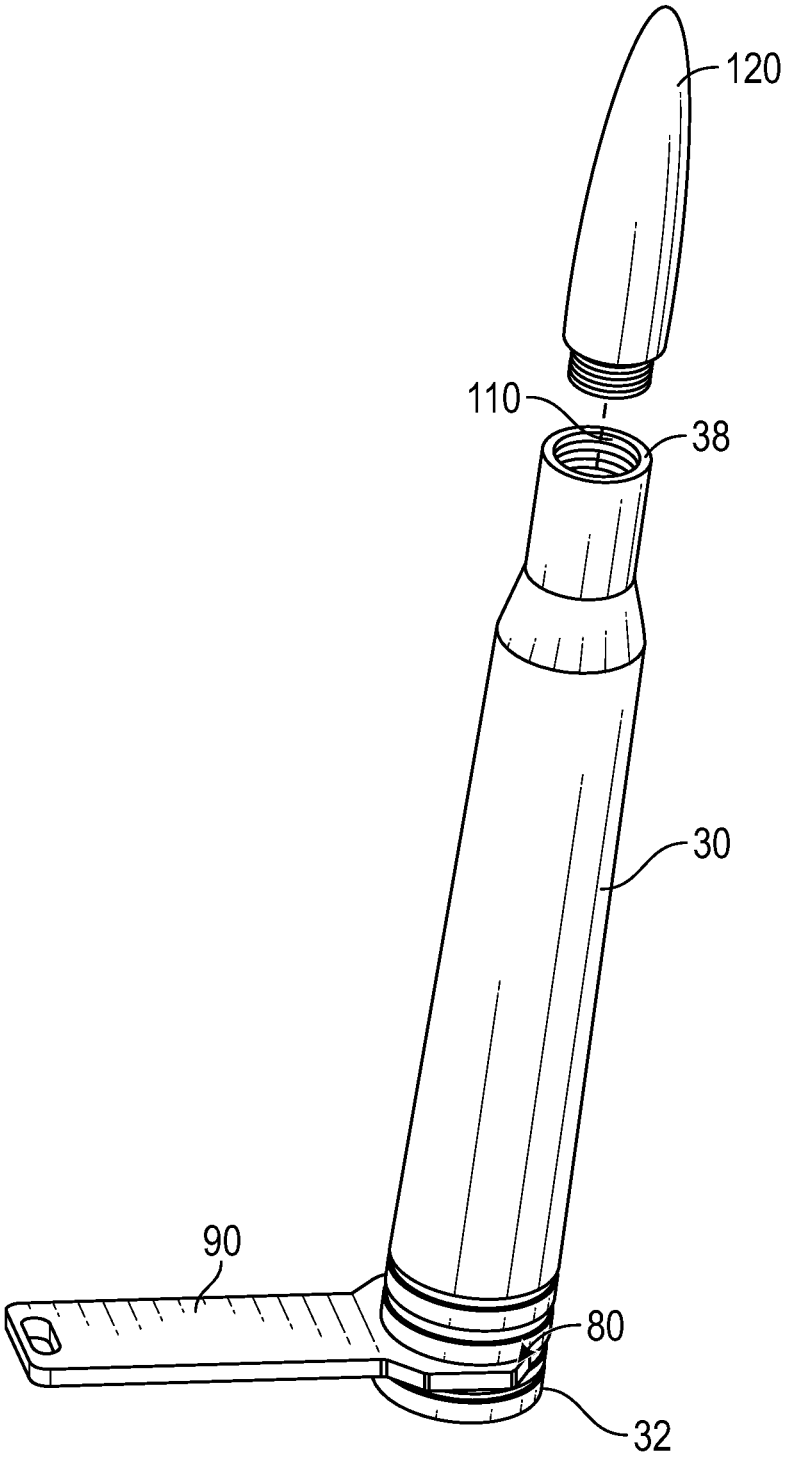
FIG. 6 is a top exploded perspective view of the alternate embodiment, illustrated with the wrench engaged with a first groove of the body.

In an alternate embodiment of the antenna 10, resembling a cruise missile, the elongated body 30 includes a threaded axial aperture 110 into which a threaded cone piece 120 is threaded or screwed, and which is preferably made from a material having a visual distinction with that of the elongated body 30 (FIG. 6).

While a particular form of the invention has been illustrated and described, it will be apparent that various modifications can be made without departing from the spirit and scope of the invention. For example, various types of body shapes may be utilized resembling multiple different items, such as a spike (FIG. 1), a cruise missile (FIGS. 5-6), an ammunition round (not shown), a standard antenna (not shown), or other items as desired. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An antenna for a vehicle of the type having a threaded antenna aperture traversing a body of the vehicle, the antenna comprising:

an elongated body having a top end, a bottom end, and at least one peripheral side, the bottom end having an axial bore partially through the body and adapted to receive an antenna wire within, the axial bore having threads at the bottom end extending upward at least partially through the axial bore, a conductive threaded shaft threaded partially into the axial bore such that a bottom end projects out of the axial bore, the bottom end of the conductive threaded shaft adapted for threading into the threaded antenna aperture of the vehicle;

a first groove formed around the at least one peripheral side of the body, the first groove having a back wall that is substantially circular in cross-section except for two opposing parallel sides adapted for contacting two opposing sides of a wrench having a thickness smaller than the width of the first groove;

whereby with the conductive threaded shaft screwed into the threaded antenna aperture of the vehicle and with the body tightened by rotating the body with the wrench at the first groove, the antenna wire is electrically connected with the threaded antenna aperture of the vehicle.

2. The antenna of claim 1 wherein the elongated body is made from an anodized metal material, such that the elongated body contacting the vehicle does not short the antenna wire to ground.

3. The antenna of claim 1 wherein at least one additional groove is formed around the at least one peripheral side of the body proximate the first groove.

4. The antenna of claim 1 wherein the first groove is formed proximate the bottom end of the elongated body.

5. The antenna of claim 1 wherein the top of the elongated body includes a threaded axial aperture into which a threaded cone piece is threaded.

6. The antenna of claim 5 wherein the threaded cone piece is made from a different material than that of the body.

7. The antenna of claim 1 wherein the bottom end of the elongated body is generally cylindrical.

8. The antenna of claim 1 wherein the top end of the elongated body is generally conical.

* * * * *